United States Patent [19]

Goytisolo Taltavull

[11] 3,978,332

[45] Aug. 31, 1976

[54] LIGHTING APPARATUS WITH BATWING LIGHT DISTRIBUTION

[76] Inventor: Ignacio Goytisolo Taltavull, Calle Madrazo, 83, Barcelona, Spain

[22] Filed: July 14, 1975

[21] Appl. No.: 595,424

[52] U.S. Cl. ..... 240/51.11 R; 240/103 R; 240/106 R

[51] Int. Cl.[2] ..... F21V 7/00

[58] Field of Search ..... 240/51.11 R, 106, 103 R, 240/103 B

[56] References Cited

UNITED STATES PATENTS

| | | | |
|---|---|---|---|
| 3,265,887 | 8/1966 | Wince | 240/51.11 R |
| 3,329,812 | 7/1967 | Harling | 240/106 R X |
| 3,721,818 | 3/1973 | Stahlhut | 240/106 R |
| 3,735,124 | 5/1973 | Stahlhut | 240/106 R |
| 3,832,541 | 8/1974 | Bassett et al. | 240/106 R |
| 3,866,036 | 2/1975 | Taltavull | 240/51.11 R |

*Primary Examiner*—Joseph F. Peters, Jr.
*Attorney, Agent, or Firm*—Wenderoth, Lind & Ponack

[57] ABSTRACT

A lighting apparatus includes a housing with an inner reflecting surface and with a lateral curved wall the profile of which is made up of several circular arcs with distinct radii and distinct centers. The housing has disposed in its interior a light source, and between the same and the mouth of the housing there is disposed a prismatic device the dimensions of which are in general somewhat larger than the area occupied by the light source. The prismatic device has a lower face the surface of which is plane and has on its top face a series of adjacent salient ribs the cross section of which is triangular and the top edges of which are replaced by a portion of rectangular cross section the upper surface of which is opaque. When the light source is constituted by parallel fluorescent tubes the housing then has a vertical symmetry plane parallel to the fluorescent tubes, its lateral walls are cylindrical surfaces and the prismatic device is rectangular with the triangular ribs disposed longitudinally. When the light source is a discharge bulb, the housing then has a symmetry axis which passes through the light emitting source of the bulb, the lateral surface of the housing is a rotary surface and the prismatic device is circular with its triangular ribs circular and concentric.

11 Claims, 10 Drawing Figures

LIGHTING APPARATUS WITH BATWING LIGHT DISTRIBUTION

CROSS REFERENCE TO RELATED PATENT

The subject matter of this application is related to the subject matter of my U.S. Pat. No. 3,866,036 issued on Feb. 11, 1975.

BACKGROUND OF THE INVENTION

The invention refers to a lighting apparatus having a batwing type of distribution of the luminous flux, the light source of which may be constituted by fluorescent tubes or by a discharge bulb.

The different studies made during recent years about reflected glare and direct glare, that is, about "Veiling Reflections" and "Discomfort Glare", have resulted in similar conclusions that are revealed by the candlepower distribution of some luminaires, which are intended to obtain a maximum candlepower in the 40°–45° zone from nadir with candlepower at nadir being ideally as low as possible.

Summing up, in a vertical cross plan of a luminaire with fluorescent lamps or with a discharge bulb, it is desired to have a minimum light distribution under 30°, a maximum light distribution between 40° and 50°, and a minimum over 60°, because over 60° discomfort glare takes place, and under 30° veiling reflection takes place. This type of distribution is known as "batwing distribution".

In my previous patent No. 3,866,036 an optical device is described to obtain a batwing type of illumination in lighting apparatus fitted with fluorescent tubes, such device including strips of transparent material with an even and smooth face, an opposite face provided with triangular longitudinal prisms the top edges of which are cut off and replaced by rectangular prismatic portions with their free surfaces opaque or opal, each one of said strips being placed beneath each fluorescent tube of the lighting apparatus with their prismatic face directed towards the tube. The light rays the direction of which is near to the vertical are intercepted by the opaque or opal surfaces or are diverted laterally by the triangular prisms, the device thus giving a batwing illumination.

I have found that the light distribution and the output of such device may be improved by placing the lighting source and the optical device in a housing having a suitable configuration resulting in a lighting apparatus that fulfills the IES recommendations for the most efficient use of energy, that is, limiting the glare lumens and obtaining the maximum visibility lumens, such result being accomplished by using either fluorescent lamps or discharge bulbs as lighting sources.

SUMMARY OF THE INVENTION

Accordingly, an object of the invention is to obtain an improved lighting apparatus with relation to a lighting apparatus using the optical device of my U.S Pat. No. 3,866,036.

Another object of the invention is to provide the lighting apparatus with fluorescent tubes as light source and giving a distribution of the luminous flux of the type called "batwing distribution".

A further object of the invention is to provide a lighting apparatus having a batwing type distribution and which emloys a discharge bulb as a light source.

With the above in mind, the invention consists of a lighting apparatus comprising a housing which contains a lighting source and a prismatic device, the distribution of the flux being a consequence of the reflective effect of the interior surface of the housing and the refractive effect of the prismatic device, the housing having a profile such that the reflected light emerge therefrom with the most convenient inclination.

In a first embodiment the housing has a cylindrical form, the light source consists of one or several fluorescent tubes, with their axes parallel to the axe of the housing, and the prismatic device is similar to that disclosed in my U.S Pat. No. 3,866,036 and has a rectangular form with a length and width approximately equal to those of the whole of the fluorescent tubes of the apparatus and is fitted beneath the fluorescent tubes.

In a second embodiment in which the lighting source is a discharge bulb, the housing is of a rotary form and the prismatic device is of a circular form, the housing, the light emitting point of the bulb and the prismatic device being coaxial.

DESCRIPTION OF PREFERRED EMBODIMENTS

Figure 1:
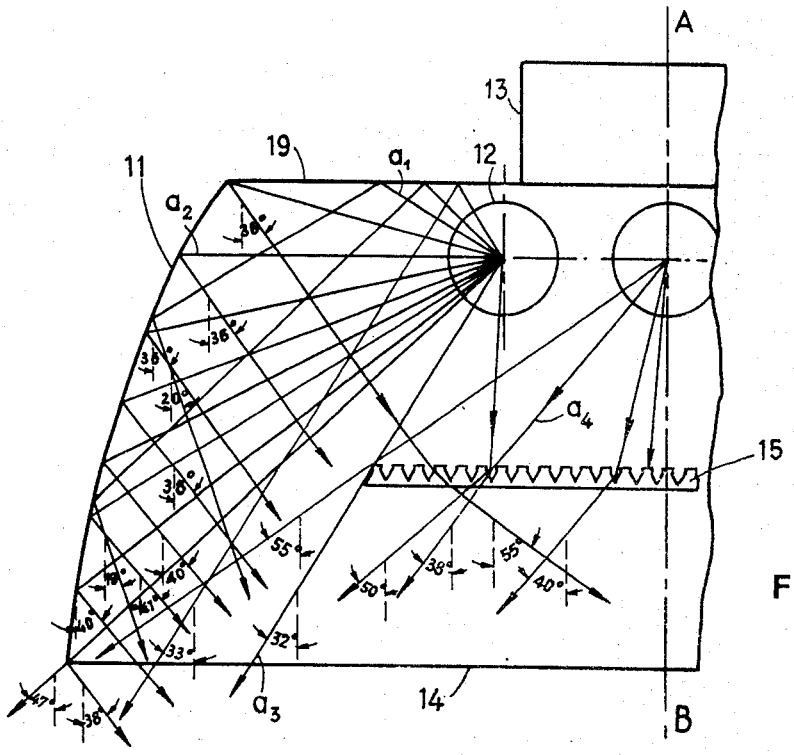
FIG. 1 is a partial view in transversal section taken along line 1—1 of FIG. 2 of a lighting apparatus fitted with fluorescent lamps comprising the reflecting housing, the refracting device and showing the path of the luminous rays.
Figure 2:
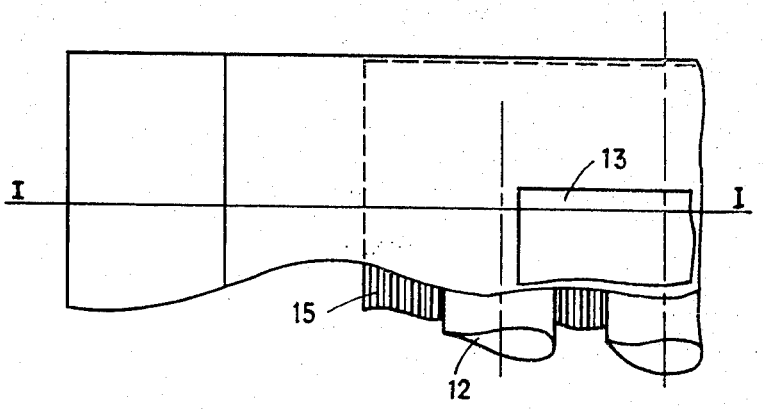
FIG. 2 is a partial top view of the same apparatus.

The apparatus of the invention represented in FIGS. 1 and 2 is a lighting apparatus with fluorescent tubes which comprises a reflecting housing 11, in which a certain number of fluorescent tubes 12 are fitted, as well as the ballast and other auxiliary elements represented by 13, and a refracting device of transparent plastic straight elements of prismatic form represented by 15.

The reflecting housing 11 of FIGS. 1 and 2 has a vertical plan of symmetry A–B, has a flat top 19 and an open lower mouth 14, and the sides 11 are made of sections composed of portions of a circular form of different radii, the resulting cylindrical surface 11 being such that, as shown in FIG. 1, the light rays that leave the tubes 12 are reflected in the semispecular anodized aluminum interior surface of the housing forming angles comprised between 19° and 41° with the vertical.

In FIG. 1 there are four types of emerging rays. Type $a_1$ corresponds to the rays that undergo two reflections, a first reflection at the flat top 19 of the housing and a second reflection at the curved sides 11 of the housing. Type $a_2$ corresponds to the rays that undergo one reflection at the curved sides 11. Type $a_3$ corresponds to the rays which pass directly through the gap between the side 11 of the housing and the prismatic device 15. Type $a_4$ corresponds to the light rays that pass by refraction through the prismatic device 15.

Figure 6:
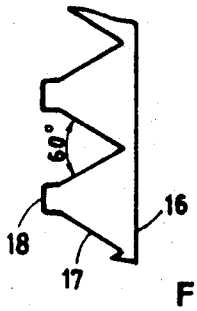
FIG. 6 is a partial detail of the prismatic device of FIGS. 1 or 3.

The FIG. 6 represents the normal section view on an enlarged scale, of a part of the refracting device 15. These straight prismatic elements form a top dented surface 17–18 and a flat lower surface 16, and adjacent flat sides 17 forms with each other angle of 60°, while the upper rectangular portion 18 has a coating such as white paint. This prismatic device 15 is situated horizontally and parallel to the tubes 12 at a position half way between the tubes 12 and the mouth 14 of the housing 11. Device 15 is as long as the fluorescent tubes and has a width something larger than the whole transversal width of the fluorescent tubes 12.

Figure 7:
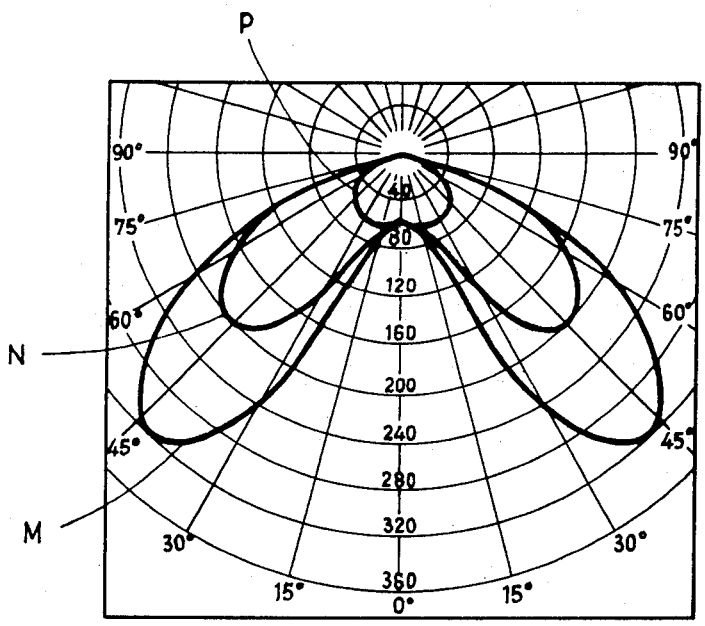
FIG. 7 is a diagram showing batwing batwng type luminous flux distribution curves of a fluorescent lamp lighting apparatus of the invention according to FIGS. 1 and 2.

Rays of the type $a_4$ are refracted through the prismatic device 15 as shown in FIG. 7 of U.S. Pat. No. 3,866,036, thus forming angles between 38° and 55° with the vertical.

In other words, the luminous flux provided by the apparatus of FIGS. 1 and 2 is of batwing type distribution.

In FIG. 7 are shown the three curves M, N, P, which correspond to the candlepower distribution based on 1000 lumens in a plane through the fluorescent tubes for type M, in a plane parallel to the tubes for type P, and in a plane diagonal to the tubes for type N. The efficiency is very good, near to 60%, and these photometric curves correspond to the best criterion of I.E.S. for batwing distribution.

Figure 3:
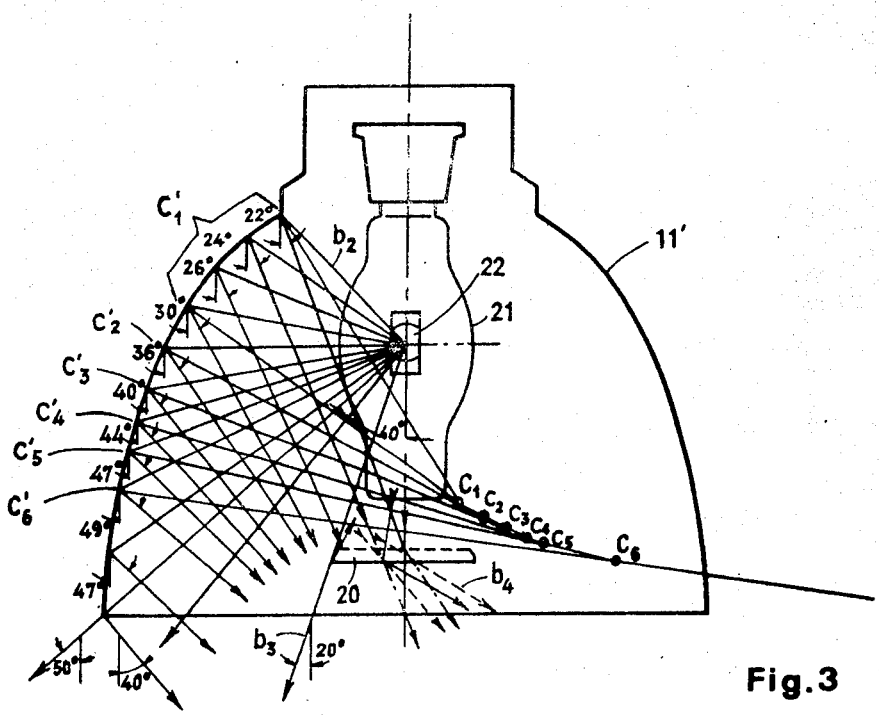
FIG. 3 is a full view in axial section of a lighting apparatus fitted with a vertical discharge bulb comprising the reflecting housing in rotary form, the refracting device in circular form and showing the path of the luminous rays.

The FIG. 3 represents the apparatus of the invention when the lighting source is with a clear discharge bulb 21, that is, a theoretically point of emission 22. The housing 11' is of a rotary form similar to a dome, and as a consequence the lighting distribution is of the so called "radial type". As the bulb is in its vertical dimensions larger than the fluorescent lamps, the housing does not have a flat top surface and the meridian section curve is composed of circular portions with centers of curvature in $C_1$, $C_2$, $C_3$, $C_4$, $C_5$, $C_6$, which constitute an "evolute" in the form of a spiral arc. The rays $b_2$ that leave the source of emission 22, are reflected by the semispecular anodized aluminium or white brilliant painted interior of the dome in the points $C'_1 \ldots C'_6$ and emerge forming with the vertical angles between 22° and 49°. The rays $b_3$ that emerge at angles with the vertical between 20° and 50° correspond to the rays which pass directly through the gap between the housing 11' and the prismatic device 20 situated horizontally under the bulb near the mouth of the housing 11'.

Prismatic device 20 is of circular form, i.e., like a disc, the upper face of which having a plurality of concentric circular ribs with a triangular cross section with their free salient angle replaced by a portion of rectangular cross section. Because the ribs are equivalent to the triangular prisms of the prismatic device 15 described with reference to the apparatus of FIGS. 1 and 2, they will be referred to in the present specification as "circular prisms".

Figure 4:
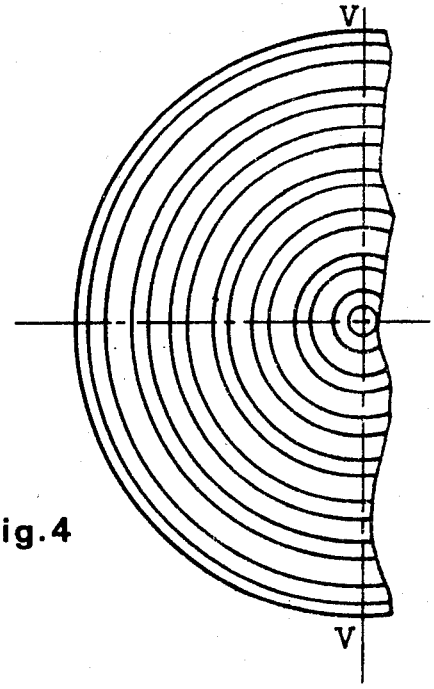
FIG. 4 is a partial top view of the refracting device in a circular form represented in 4/1 scale with respect the device shown in the FIG. 3.
Figure 5:
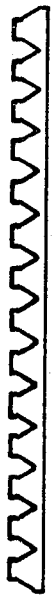
FIG. 5 is a diametrical section taken along V—V of FIG. 4 of the refracting device of FIG. 4.

Prismatic device 20 is of circular form as is shown in FIG. 4 which represents the prismatic device on an enlarged scale and in plan view whereas FIG. 5 is a diametrical section of the prismatic device showing that the cross section of the circular prisms is the same as described with reference to the apparatus of FIG. 1. Consequently the rays $b_4$ which strike on the upper face of the prismatic device 20 are refracted forming angles between 38° and 55° with the vertical as in the apparatus of FIG. 1.

Figure 8:
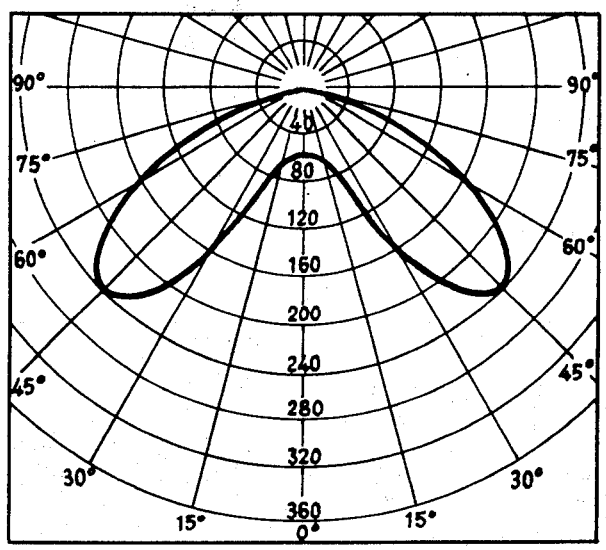
FIG. 8 is a diagram showing the batwing type luminous flux distribution curves of a bulb lighting apparatus of the invention according to FIGS. 3 and 4.

FIG. 8 shows the candlepower distribution curve based on 1000 lumens of the apparatus of FIG. 3. This unique curve is the same according to the different axial planes of the bulb and as a consequence the efficiency in this case is near 70%.

Although in the example of FIG. 3 the bulb 21 is placed in a vertical position, similar results can be obtained by placing the bulb in a horizontal position.

Figure 9:
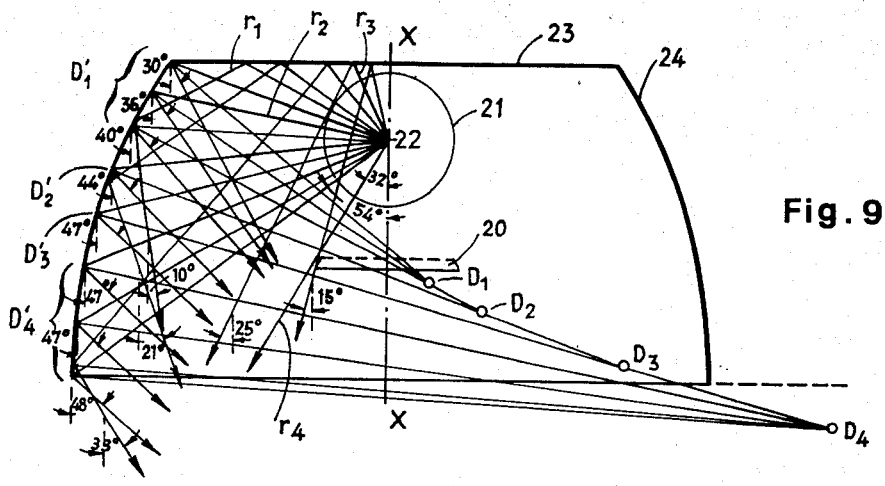
FIG. 9 is a full view in axial section of a lighting apparatus fitted with a horizontal bulb lamp which is viewed in cross section, comprising the reflecting housing in rotary form, the refracting device in circular form and showing the path of the luminous rays in the housing.
Figure 10:
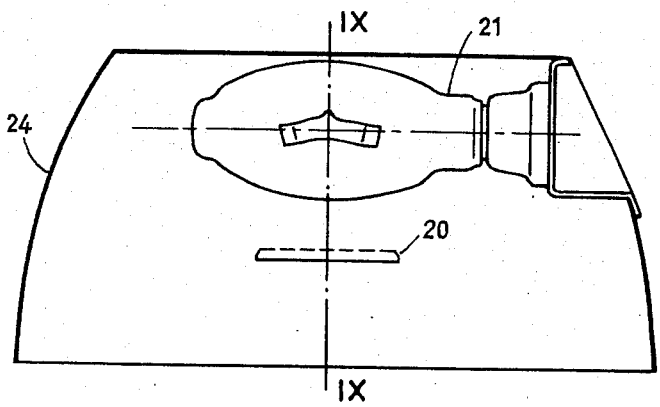
FIG. 10 is a full view of the apparatus of FIG. 9 in axial section along an axial plane perpendicular to the plane of FIG. 9, showing the bulb in longitudinal section.

The FIG. 9 represents the apparatus of the invention when the lighting source is a clear discharge bulb 21 but in a horizontal position. This FIG. 9 is a section taken along the plane IX—IX of FIG. 10, and the FIG. 10 is a section taken along the plane X—X of FIG. 9. The object of this embodiment is to obtain a batwing type distribution for HID lamps mounted in such a position that the box depth is kept at a minimum.

The housing 24 is of a rotary form with a flat top 23, the refractor 20 is equal to and has a similar function as the device 20 of FIG. 3 and is represented also by FIG. 4 and FIG. 5. The section on the meridian curve of the housing is composed of circular portions with centers of curvature in $D_1$, $D_2$, $D_3$, $D_4$. The light rays $r_1$ which are first reflected at the flat top 23 and undergo a second reflection at the sides 24, emerge forming with the vertical angles between 10° and 33°. The rays $r_2$ that undergo only a reflection at the sides 24 emerge forming angles between 30° and 48° with the vertical. The rays $r_3$ that undergo only a reflection at the flat top 23 emerge forming angles between 15° and 41° with the vertical. Finally the direct rays $r_4$ (without reflections) emerge with angles between 32° and 54° with the vertical. Other luminous rays (not shown in FIG. 9) will strike the circular prisms of the optical device and will be refracted through them in a manner analogous with that shown in FIG. 3.

As the normal diameter in the base of the housing 24 is about 16 inches it is possible to combine it with a box 2'×2' which would contain, furthermore, the ballast, capacitor and other equipment for HID lamps constituting thus a complete lighting unit.

When the discharge bulb is not a clear one but a phosphor coated bulb of the M-175 S Metal Halide type, the direct vision of same in the zone between 32° and 54° with the vertical shall be less offensive but the light control shall be less precise.

If the distance between the refractor disc and the bulb is reduced, the zone of direct vision is also reduced, it being possible to obtain the same effect increasing the diameter of the refractor disc.

What I claim is:

1. A lighting apparatus with batwing light distribution comprising a housing with a reflecting inner surface, a lighting source in the housing and a prismatic refracting device beneath the lighting source, said housing having a lateral surface with a profile composed of several circular arcs with different radii and centers, and said prismatic refracting device, which has slightly larger dimensions than the area of said light source, comprises in a transparent plate having a lower face formed by a plane surface and an upper face formed by a plurality of triangular prisms contiguous with each other, the free salient angles of said prisms being truncated and replaced by rectangular prismatic portions of low height, the free face of each of which has a surface capable of intercepting luminous rays which strike them.

2. A lighting apparatus which comprises a housing with an inner reflecting surface, presenting a vertical symmetry plane; at least one fluorescent tube located in the upper part of said housing, the axes of said tube or tubes being arranged parallel to said symmetry plane and in a plane perpendicular to said symmetry plane; and an optical device arranged parallel to said fluorescent tubes approximately midway between the fluorescent tubes and the mouth of the housing, said optical device comprising a rectangular transparent plate the length of which is substantially equal to the length of the fluorescent tubes, the width of said optical device being somewhat larger than the space taken by the width of the assembly of the fluorescent tubes, the lower surface of said optical device being plane and the upper surface thereof being provided with a plurality of triangular longitudinal prisms adjacent to each other, the top edge of each of said prisms being truncated and replaced by a rectangular prismatic portion of low height the top free surface of which being able to prevent the passage of light rays.

3. A lighting apparatus as claimed in claim 2, wherein said housing comprises a plane top surface, two end walls and two cylindrical side walls each of which presents a profile composed of circular arcs with different radii and different centers, said centers defining a spiral arc, the curvature of the ensemble of said profiles being such that light rays coming from the fluorescent tubes and directly striking the cylindrical lateral walls or after undergoing a first reflection on the plane top wall of the housing are reflected forming angles between 19° and 41° with the vertical.

4. A lighting apparatus as claimed in claim 2, wherein the prisms of said optical device possess plane sides which form an angle of 60° with each other.

5. A lighting apparatus according to claim 2, wherein the top free surface of the top rectangular prismatic portion of each triangular prism has thereon a white opaque or semitranslucid paint layer.

6. A lighting apparatus which comprises a housing with an inner reflecting surface and which has a vertical symmetry axis; a high intensity discharge bulb positioned in the upper inner part of said housing and arranged in such a way that the light emitting element thereof substantially coincides with said symmetry axis; and an optical device comprising a disc made of a transparent material and arranged perpendicularly to said symmetry axis at a position approximately midway between the bulb and the mouth of the housing, the diameter of said disc being slightly larger than the largest dimension of the projection of the discharge bulb on to said disc; said disc having a lower plane surface and a top surface provided with a plurality of concentric and adjacent circular ribs which have a triangular cross section, the top vertices of said ribs being truncated and replaced by a rectangular portion of low height, the free top surface of said ribs being of such a nature that it is able to prevent the passage of light rays.

7. A lighting apparatus according to claim 6, wherein said housing comprises a lateral rotary wall the generatrix curve of which is composed of circular arcs with different radii and different centers, said centers defining a spiral arc, the curvature of the ensemble of said generatrix being such that light rays coming from the discharge bulb strike said rotary surface and are reflected forming angles between 30° and 48° with the vertical.

8. A lighting apparatus according to claim 6, wherein the section across the circular ribs of said optical device possess straight sides which form an angle of 60° with each other.

9. A lighting apparatus according to claim 6, wherein the free top surface of the circular ribs of said optical device each has thereon a white opaque or semitranslucid paint layer.

10. A lighting apparatus according to claim 7, wherein said housing has a substantially dome-shaped form, and the discharge bulb is located with its vertical axis coaxially with said housing.

11. A lighting apparatus according to claim 7, wherein said housing has a top plane wall, the discharge bulb being horizontally arranged in a position adjacent said top plane wall.

* * * * *